US007055187B1

(12) United States Patent
Fields

(10) Patent No.: US 7,055,187 B1
(45) Date of Patent: Jun. 6, 2006

(54) BATHING APPARATUS WITH BATHTUB AND BANISTER

(76) Inventor: J. Burford Fields, 17150 Downing St. #202, Gaithersburg, MD (US) 20877-3629

( * ) Notice: Subject to any disclaimer, the term of this patent is extended or adjusted under 35 U.S.C. 154(b) by 160 days.

(21) Appl. No.: 10/764,596

(22) Filed: Jan. 23, 2004

(51) Int. Cl.
*A47K 3/02* (2006.01)

(52) U.S. Cl. ..... 4/560.1; 4/578.1; 4/590

(58) Field of Classification Search ..... 4/538, 4/555, 560.1, 561.1, 571.1, 573.1, 571.5, 4/576.1, 578.1, 579, 585, 589, 590, 575.1
See application file for complete search history.

(56) References Cited

U.S. PATENT DOCUMENTS

| | | | | | |
|---|---|---|---|---|---|
| 1,024,329 | A | | 4/1912 | Grow | |
| 1,301,114 | A | * | 4/1919 | Eppler | 4/575.1 |
| 1,934,117 | A | | 11/1933 | Daley et al. | |
| 1,962,076 | A | * | 6/1934 | Jadkowski | 4/590 |
| 2,242,939 | A | | 5/1941 | Buckel | |
| 2,314,044 | A | | 3/1943 | Hunting | |
| 2,604,638 | A | | 7/1952 | Furry | |
| 2,624,053 | A | | 1/1953 | Beckwith | |
| D173,667 | S | | 12/1954 | Meyer | |
| 2,725,578 | A | | 12/1955 | Keller | |
| 2,788,055 | A | | 4/1957 | Tumas | |
| 2,788,527 | A | | 4/1957 | Steven | |
| 3,045,255 | A | | 7/1962 | Pirtle et al. | |
| 3,882,553 | A | | 5/1975 | Poiencot | |
| 4,028,751 | A | | 6/1977 | Moran | |
| 4,734,944 | A | * | 4/1988 | O'Brien | 4/589 |
| D298,055 | S | * | 10/1988 | O'Brien | D24/204 |
| 5,020,168 | A | * | 6/1991 | Wood | 4/573.1 |
| 5,146,638 | A | | 9/1992 | Richards | |
| 5,168,585 | A | | 12/1992 | Cox | |
| 5,181,284 | A | * | 1/1993 | Raphael et al. | 4/572.1 |
| 5,201,084 | A | | 4/1993 | Johnson | |
| 5,226,183 | A | | 7/1993 | Clark | |
| 5,267,360 | A | | 12/1993 | Bassil et al. | |
| 5,287,568 | A | | 2/1994 | Mohrmann | |
| 5,440,766 | A | | 8/1995 | Schmidt | |
| 5,448,787 | A | | 9/1995 | Allen | |
| 5,494,718 | A | * | 2/1996 | Adams et al. | 428/35.7 |
| 5,708,992 | A | | 1/1998 | Gobbers et al. | |
| 5,937,454 | A | | 8/1999 | Drew | |
| 5,978,984 | A | | 11/1999 | Gobbers et al. | |
| 6,055,685 | A | | 5/2000 | Norton et al. | |
| 6,076,204 | A | | 6/2000 | Mullick | |
| 6,134,723 | A | | 10/2000 | Benson | |
| 6,158,809 | A | | 12/2000 | Gobbers et al. | |

(Continued)

*Primary Examiner*—Justine R. Yu
*Assistant Examiner*—Huyen Le
(74) *Attorney, Agent, or Firm*—Fields IP, PS

(57) ABSTRACT

A bathing apparatus, for use by disabled bathers, comprises a bathtub and a banister. The bathtub has a ramp and a floor. The ramp descends to the bathtub floor, which slopes gradually toward a drain. The ramp's top is approximately level with the seat of a wheel chair. The banister is coupled to the bathtub and extends over the ramp and floor of the bathtub. The banister has a sloped portion for descending into the bathtub that descends to level portion. The level portion is substantially horizontal for sitting or lying on while bathing. The level portion of the banister is over the floor and its height relative to floor increases as the floor slopes toward the drain. A bather may choose a seat height that is most comfortable by sitting on the level portion farther or closer to the drain. While bathing the bather is stabilized by the banister, feet or knees on the floor of the bathtub.

36 Claims, 4 Drawing Sheets

U.S. PATENT DOCUMENTS 6,199,226 B1 3/2001 Steadman
6,253,392 B1 7/2001 Conforti et al.
6,256,807 B1 7/2001 Steadman
6,336,230 B1 1/2002 Lane
6,363,545 B1 4/2002 Nowosad
6,381,769 B1 5/2002 Logquist, Jr.
6,397,409 B1 6/2002 Sherlock et al.
6,425,146 B1 7/2002 O'Brien et al.
6,499,153 B1 12/2002 Simoni et al.
6,615,420 B1 9/2003 Hyden

* cited by examiner

BATHING APPARATUS WITH BATHTUB AND BANISTER

FIELD OF INVENTION

This invention is generally related to bathing apparatuses and, more particularly, a bathing apparatus that may assist ease and safety for bathing by disabled persons.

BACKGROUND OF THE INVENTION

There is a need for bathtubs that provide easy access and use by persons with disabilities. These disabilities may arise from advanced age, injuries or diseases. Persons with disabilities may find it more difficult to walk, step over obstacles, balance themselves, stand, or even sit upright unassisted. Ordinary bathtubs require disabled persons to do some or all of the above. As a result, disabled persons may not be able to enter or use a bathtub safely or at all. Often hospital staff or family members must offer physical support and assistance to disabled persons in entering and using a bathtub. These staff and family members have an increased risk of strains or other physical injuries while providing the above support and assistance.

Entering ordinary bathtubs often requires stepping over the side of the tub. Even if the bathtub is sunken or even flush with the floor, balance and strength is required to step down into the tub without falling. The same is true if steps are provided to assist one in getting up and over the side of a bathtub.

Making handgrips available to one entering the bathtub may increase safety. However, even with handgrips, many persons with disabilities still do not possess the strength or balance to safely enter an ordinary bathtub. Also it may be necessary for disabled people to extend themselves in order to reach a handgrip.

Once they are inside the bathtub, persons with disabilities often find it difficult to use ordinary bathtubs. An ordinary bathtub has little that provides assistance to disabled persons in balancing themselves while standing or sitting in the tub. If the disabled person has difficulty standing or sitting upright unassisted, then they may fall while attempting to use the tub. Falling may occur while attempting to stand upright in the tub or while lowering themselves in order to sit in the tub.

Handgrips may make it easier for some disabled persons to stand or sit in a tub. But handgrips have numerous limitations. Their usefulness depends on their sturdiness, location, and number. For example, even with a number of handgrips, a disabled person who successfully steps into the tub may still suffer injury while attempting to descend to a sitting position within the tub. Further, it is often necessary to let go of the handgrips in order to grip and use soap, shampoo, or other items.

Ordinary bathtubs, with or without handgrips, also do not offer a disabled person sufficient ability to change positions within the bathtub. For example, a disabled person may need to stand or sit facing one direction and then another time stand or sit facing in a different direction. The disabled person may also at times need to be supported in order to lie safely within a bathtub.

It would be advantageous to provide a bathing apparatus that is safe and easy for disabled persons to enter, use, and exit. Preferably, such a bathing apparatus would allow a disabled person to sit, stand, or lie in a variety of supported positions.

SUMMARY OF INVENTION

In one embodiment of the present invention, a bathing apparatus may provide ease of access and support for the user during bathing.

In one embodiment of the invention, a bathing apparatus may comprise a ramp to ease entry and exit from a bathtub. A portion of the interior of the bathtub may comprise a ramp that slopes down toward the floor of the bathtub. In a particular embodiment, the top of the ramp may be disposed relative to a floor of the tub to a level that would be approximately level with the seat of a wheel chair. A bather may then enter the bathtub by sliding down a wide center "banister" that extends outwardly from a lower portion of the ramp and in angled relationship relative to the ramp.

This banister may extend with an upwardly facing surface above the bathtub floor, having a height that is relative to the floor of the bathtub. The banister becomes a center seat or rest that the bather may straddle with his or her legs in order to sit or lay in the bathtub. In some embodiments, the bathtub floor, slopes downward for draining. The height of the banister relative to the floor increases as the drain is approached. A bather may then choose a seat height that is most comfortable.

The bather sitting or resting on the center banister is stabilized by legs and knees straddling the banister, by feet or knees on the floor of the tub, and in some embodiments, by the sides of the tub to which handrails are added. In some embodiments, the end of the banister opposite the entry ramp is enlarged into a shape similar to a motorcycle gas tank. The shape allows the bather to find additional leverage for legs as well as handholds during bathing.

DETAILED DESCRIPTION

Figure 1:
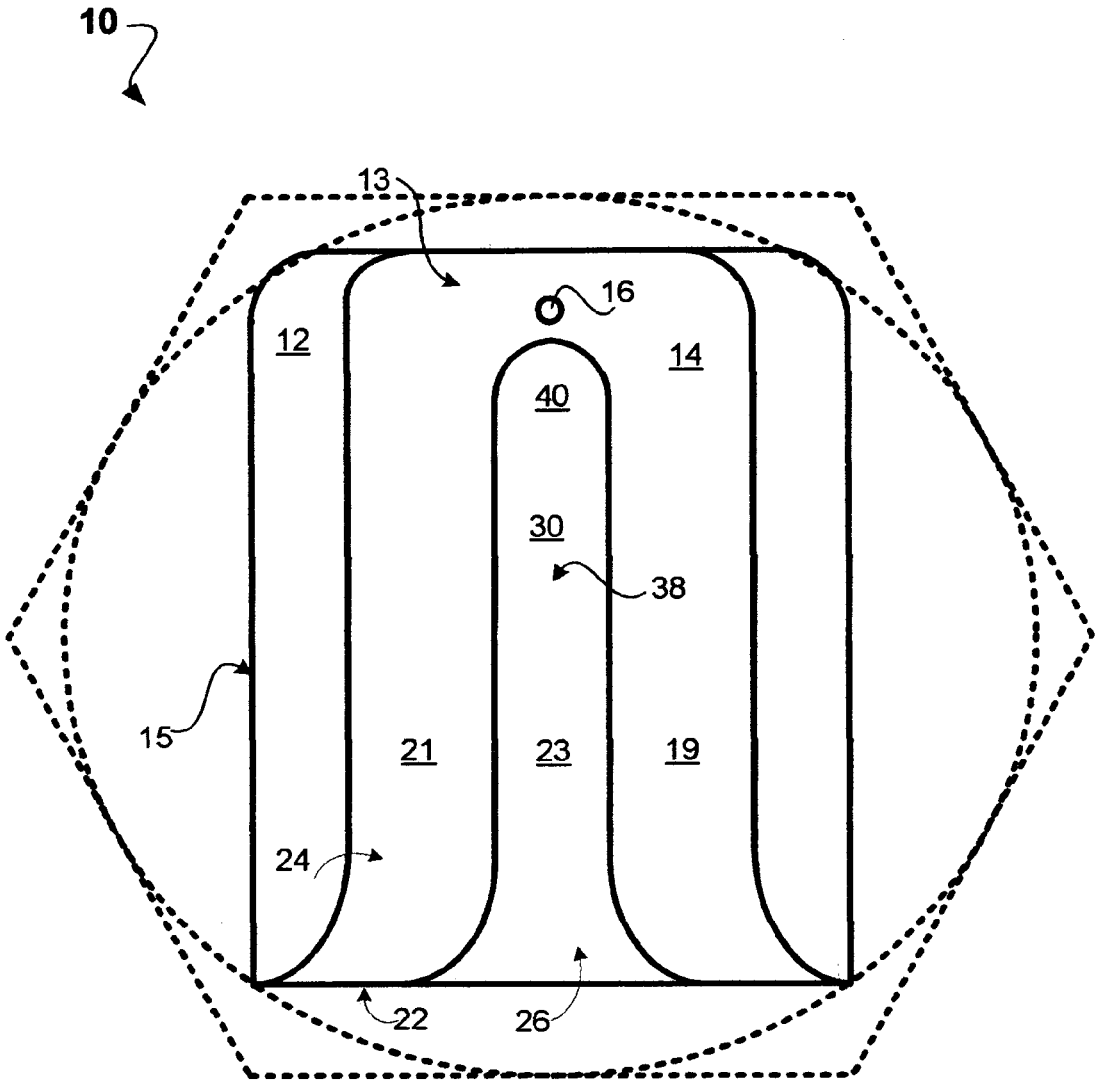
FIG. 1 is a top view of a bathing apparatus with a banister in accordance with an embodiment of the present invention.
Figure 2A:
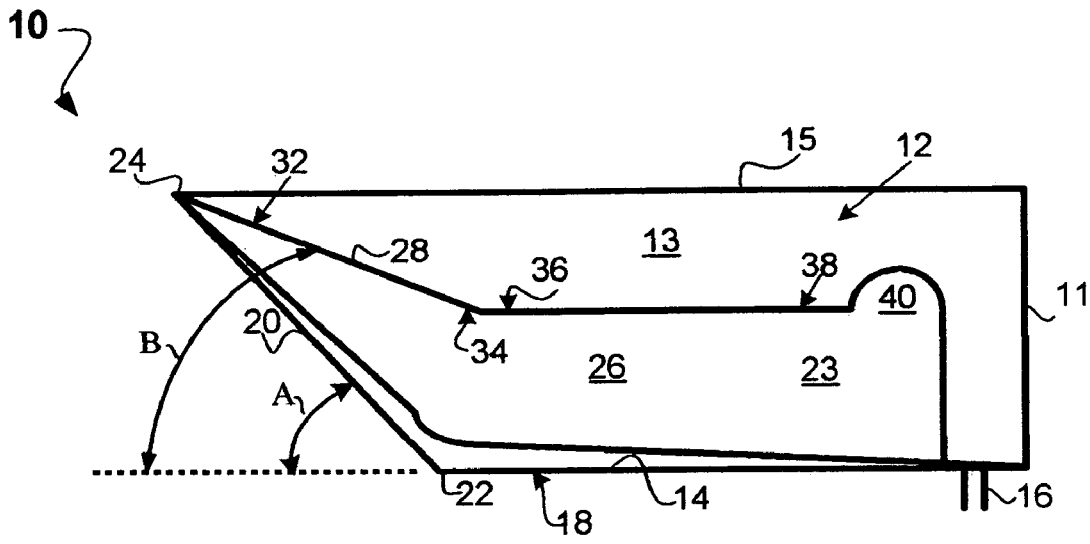
FIG. 2A is a side view of the bathing apparatus of FIG. 1 FIG.
Figure 2B:
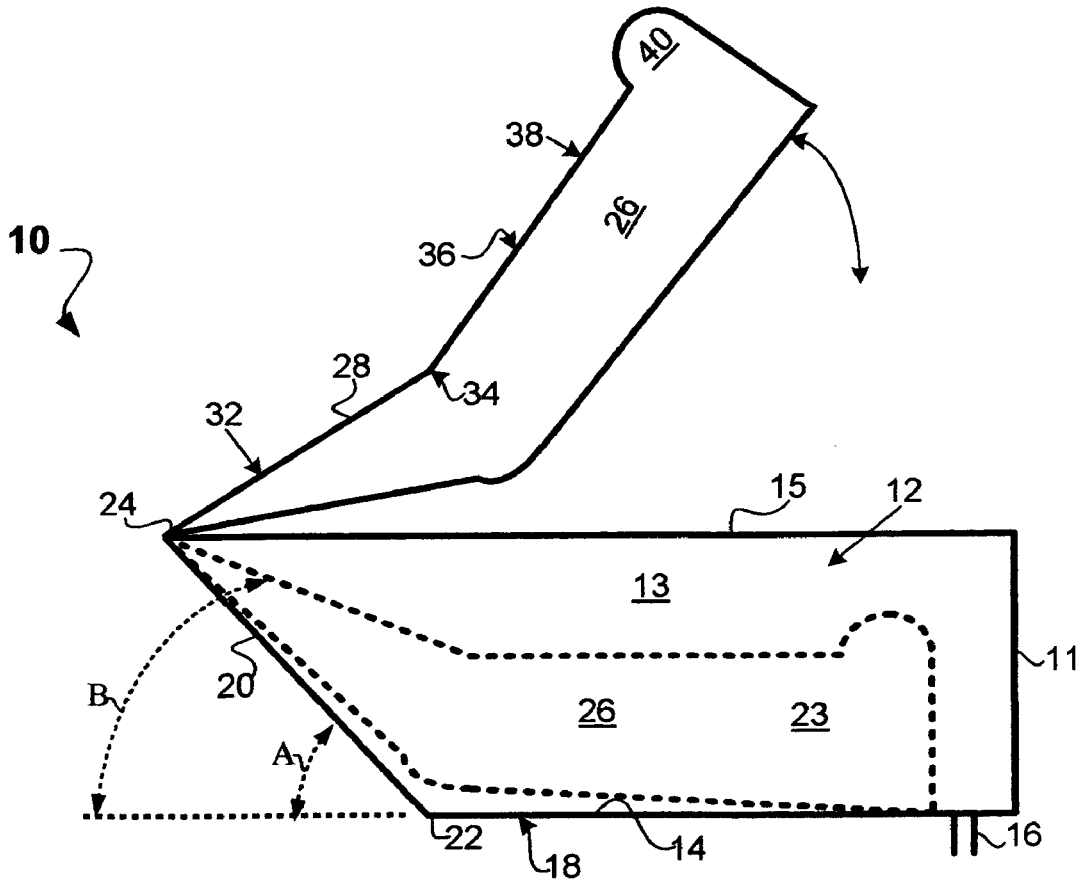
FIG. 2B is a side view of the bathing apparatus of FIG. 1, in accordance with another embodiment showing an optional hinged operability for the banister.

Referring first to FIG. 1, a bathing apparatus in accordance with an embodiment of the invention is shown. As can be seen in FIGS. 1, 2A and 2B, the bathing apparatus comprises a bathtub 10 having a bathtub inside 12 for receiving a bather for bathing. The term bathtub is used in its ordinary sense, but also is intended to include a tub, a Jacuzzi™, or a whirlpool. Bathtubs come in a variety of shapes. The bathtub 10 shown is somewhat rectangular, but in other embodiments, the bathtub 10 may be round, circular, oval, square, pentagonal or other shape (shown in phantom in FIG. 1) capable of containing a bather and water. Also, nothing is implied about the vertical placement of the bathtub relative to ground level, as some embodiments may rest at ground level, others may be sunken, and yet others may be raised above ground level by legs, a platform or other devices. The form of bathtub 10 shown is simply one of many possible forms.

The inside 12 is simply the interior surface of the bathtub that holds water. The inside 12 includes a bathtub floor 14 with a first end 18, a ramp 20 (FIG. 2A) adjacent to the floor 14 at the first end 18 and a drain 16. In the embodiment shown, the bathtub floor 14 slopes slightly in the direction of the drain 16, allowing water to drain more easily. While the bathtub 10 shown in FIGS. 2A–2B has one drain 16, other embodiments may have either no drain or a plurality of drains.

A particular embodiment of the bathing apparatus may be viewed as having walls 11 and a floor 14 defining an inside reservoir 13 for receiving water for bathing. The walls 11 have an upper rim 15 that is distal relative to the floor 14.

The bathtub floor 14 shown is somewhat symmetrical and rectangular in shape, but other shapes could be used including round, square, or irregular shapes that may or may not be symmetrical. Similarly, while the floor first end 18 shown comprises a physically discrete linear edge of the floor 14, nothing requires that the first end 18 be physically delimited from the rest of the floor 14. For example, if the bathtub floor 14 were a perfect circle, the floor first end could be a single point on the perimeter of the circle, and otherwise not be physically distinguishable from the remainder of the floor 14.

The ramp 20 has a ramp proximal end 22 and a ramp distal end 24 (FIGS. 2A–2B) with respect to the floor first end 18. The ramp 20 and the floor 14 are adjacent to each other, at the ramp proximal end 22 and the floor first end 18. Said ramp 20 slopes from about its distal end 24 to the first end 18 of floor 14 at an angle A (FIG. 2A) that allows a human being to slide safely from the distal end 24 to floor 14.

In a particular embodiment of the bathing apparatus, the ramp 20 may be viewed as having an angle A relative to the horizontal that allows a bather to slide on the ramp 20 from the direction of the upper rim 15 in the direction of the floor 14.

The bathing apparatus of FIGS. 1 and 2 also has a banister 26 for sliding into bathtub 10 and for sitting on while bathing. The banister 26 extends from about the ramp distal end 24 downward, with respect to floor 14, and then extends over a substantial length of the ramp 20 and of the floor 14. The banister 26 is coupled to the bathtub 10 in a manner that keeps the banister 26 stable and stationary enough for a bather to first slide down the banister 26 and then sit or lie on the banister 26 while bathing. The term "banister" is used in its ordinary meaning, but also includes any stable surface that may be straddled by a bather's legs while the bather safely slides down or sits on the surface.

The banister 26 may be fixedly coupled, either permanently or removably, to the bathtub inside 12 at ramp 20. There are many ways of fixedly coupling banister 26 to the bathtub inside 12, including welding, bolting, riveting, or any one of many ways known to those skilled in the art. The banister 26 and the bathtub inside 12 may also be jointly molded as a single article. The banister 26 may simply arise out of ramp 20 by descending less quickly than the ramp 20 on either side. Or, banister 26 and bathtub 10 may each be comprised of a plurality of parts or articles coupled together. The above and many other ways of accomplishing the fixed coupling will be apparent to one skilled in the art. Likewise, the coupling of banister 26 and the bathtub inside 12 may be fixedly coupled only when in actual use, but otherwise adjustably coupled for various settings for accommodating various sizes of users (e.g., adult or child), different types of uses (e.g., bathing while sitting, lying or standing), or for other reasons. As discussed below, banister 26 and the ramp 20 could also be hingedly coupled, allowing banister to swivel about the hinge.

The banister 26 could also be coupled to the bathtub at a site other than the bathtub inside 12. For example, strong tubing could be fixedly connected to the bathtub's exterior and then the tubing could be coupled to the banister, the banister never being coupled to the bathtub inside 12. Other ways of coupling or attaching the banister to the bathtub will be readily apparent to those skilled in the art.

The banister 26 includes, adjacent to each other, a descending portion 28, which could also be called a slide, and a substantially level portion 30, which could also be called a pedestal or platform. These adjacent portions could be different portions of a single structure, as in the embodiment of FIG. 1, or they could be two or more separate articles or parts coupled together.

The descending portion 28 has a descending portion upper end 32 and a descending portion lower end 34, both upper and lower being with respect to the floor 14. The substantially level portion 30 has a level portion proximal end 36, with respect to the descending portion lower end 34, the level portion proximal end 36 being adjacent to the descending portion lower end 34.

The descending portion 28 slopes at angle B from about the ramp distal end 24 to the descending portion lower end 34. The descending portion 28 may extend out over the bathtub floor 14 as shown. The slope of angle B is less than that of angle A of ramp 20 and is suitable for sliding, while sitting, from the descending portion upper end 32 to the substantially level portion 30.

The substantially level portion 30 is substantially horizontal with respect to the vertical and extends from approximately the descending portion lower end 34 out over a substantial portion of the floor 14. The substantially level portion 30 has an upper surface 38. The height of the upper surface 38 relative to the floor 14 and the length of the upper surface 38 being suitable for a bather to sit on the upper surface 38. The length of the upper surface 38 may also be great enough to allow a bather to lie on the upper surface 38.

Part of the substantially level portion 30 is enlarged upward from its upper surface 38, away from the floor, in a curved manner to create a curved enlarged portion 40. In this embodiment the enlarged portion 40 is can be viewed as being formed by the upper surface 38 first curving upward and then curving downward, relative to the floor. The enlarged portion 40 may allow a bather greater stability when lying or sitting on the upper surface 38 by preventing excessive forward sliding. In the embodiment shown, the enlarged portion 40, is at the end of the level portion 30 farthest from the descending portion 28.

The height of the distal end 24 of the ramp 20 is about the same height, relative to ground level, as a wheel chair. This may allow a bather in a wheel chair to be able to slide directly from the wheel chair, down the ramp 20, to the upper surface 38 of the substantially level portion 30. If necessary, the wheel chair bound bather's feet may be lifted over the ramp distal end 24 to allow the slide.

In the embodiment shown, the height of the bathtub inside 12, relative to the floor 14, is higher than the height of the upper surface 38 of the substantially level portion 30 of the banister 26. This allows the water level in the bathtub inside 12 to be higher than the seat of a bather sitting on the upper surface 38 of the substantially level portion 30. That obviously allows more of the bather's body to be submerged while sitting or lying on the upper surface 38. This provides flexibility to vary the bath level according to the needs of the bather. The bathtub inside 12 could be left empty and the bather and/or attendant could rely upon a shower, or hand-shower. Or the inside 12 could be filled partway for a sponge bath. Or, the inside 12 could be filled more entirely, in the manner of a whirlpool bath or Jacuzzi.

In the embodiment shown, the banister 26 is centered relative to the ramp 20 and the floor 14 so that it bisects them. A bather is therefore positioned in a central position within the inside 12 of the bathtub 10. However, there may be reasons to not center the banister with respect to the ramp 20 and floor 14, depending on the overall design of the bathtub 14 and the needs of the bathers or their attendants.

Also, as noted previously, in the embodiment shown the bathtub floor 12 slopes slightly in the direction of drain 16, allowing water to drain more easily. Another advantage of slight slope in floor 14 is that the height of the upper surface 38 relative to the floor 14 increases as the distance to drain 16 decreases. Thus, a bather with short legs (such as a child) may sit on the upper surface 38 farther away from drain 16 and still have his or her feet resting on floor 14. A taller bather who feels more comfortable with a higher seating height can sit closer to drain 16. Likewise, a bather who desires to kneel astride the upper surface 38 of the substantially level portion 30 can kneel farther away from the drain 16, allowing the knees to rest on floor 14.

Another option is to hingedly couple the banister 26 to the inside 12 at the ramp distal end 24 allowing the banister 26 to be raised to slope in the direction of the ramp distal end 24. Then, once bathing is completed, a wheel-chair bound bather may be returned to his or her wheel chair in an opposite manner by raising the end of the banister 26 farthest from the ramp 20. The banister 26 then swivels upward from the ramp distal end 24, so that the bather slides down toward the ramp distal end 24. Or the entire bathtub 10, once it is drained, is tilted up so that the bather astride the banister 26 slides towards the ramp distal end 24 and to his or her wheel chair.

In a particular embodiment of the bathing apparatus, ramp 20 and the bathtub floor 14 may, according to a top view, comprise a first subregion 19, a second subregion 21, and a third subregion 23. The first subregion 19 and the second subregion 21 are at least partly adjacent to each other and also may be partly adjacent to the third subregion 23. The third subregion 23 is then defined between part of the first sub region 19 and part of the second subregion 21. The second subregion 21 commences at about the upper rim 15 and extends, again in a top view, a substantial distance into floor 14. The third subregion 23, as viewed from a side, has a height and a length relative to the first subregion 19 and the second subregion 21. The third subregion 23 has a descending portion 28 and a substantially level portion 30. The descending portion 28 extends from about the upper rim 15 in the direction of floor 14. The height of the descending portion 28 gradually increases to form a slope as the descending portion 28 extends from about the upper rim 15 toward floor 14 to allow a bather to slide on the descending portion 28 from the direction of the upper rim 15 in the direction of floor 14. The substantially level portion 30 has an upper surface 38 relative to floor 14. The height and length of the substantially level portion 30 allow a bather to sit on the upper surface 38 with feet extending toward or resting on floor 14.

Figure 3:
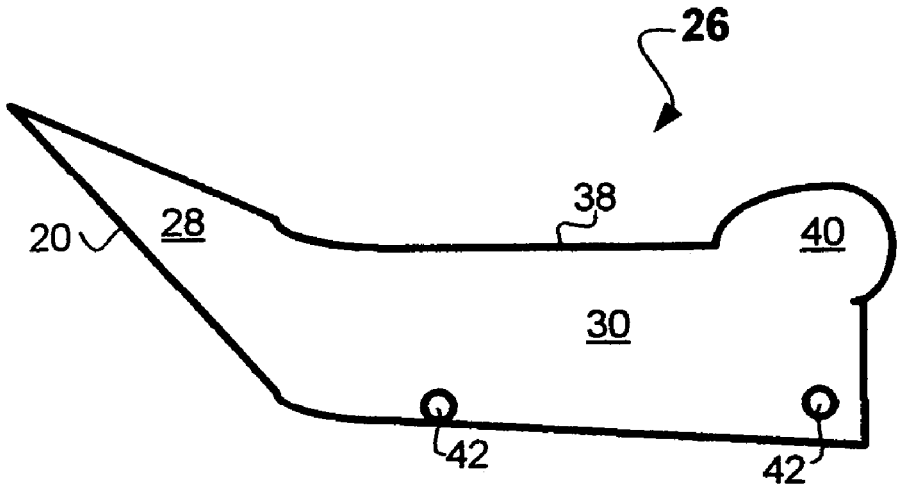
FIG. 3 is a side view of a banister for a bathing apparatus for an embodiment of the present invention.
Figure 4:
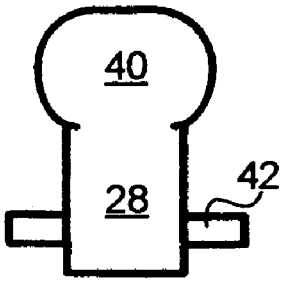
FIG. 4 is a front view of the banister of FIG. 3.
Figure 5:
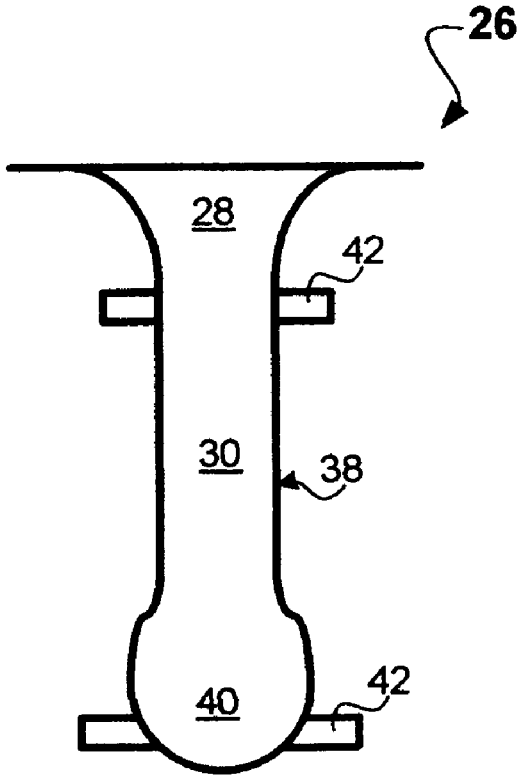
FIG. 5 is a top view of the banister of FIG. 3.

A second embodiment of a banister 26 is also shown in FIGS. 3–5. FIG. 3 shows a side view, FIG. 4 a front view with respect to the substantially level portion 30, and FIG. 5 a top view of the banister 26, including a descending portion 28 and a substantially level portion 30, an upper surface 38 of the substantially level portion 30, and an enlarged portion 40. Two extensions 42 protrude from the substantially level portion 30, providing hand or foot holds. While extensions 42 are shown, indentations could also be used to provide support for the feet or hands.

In the second embodiment, the level portion 30 extends in a curved manner both laterally, with respect to floor 14, and upwardly out of the upper surface 38, to form the enlarged portion 40. The result is an enlarged portion 40 shaped similar to a motorcycle gas tank, allowing a bather to perhaps find additional leverage for the legs.

Figure 6:
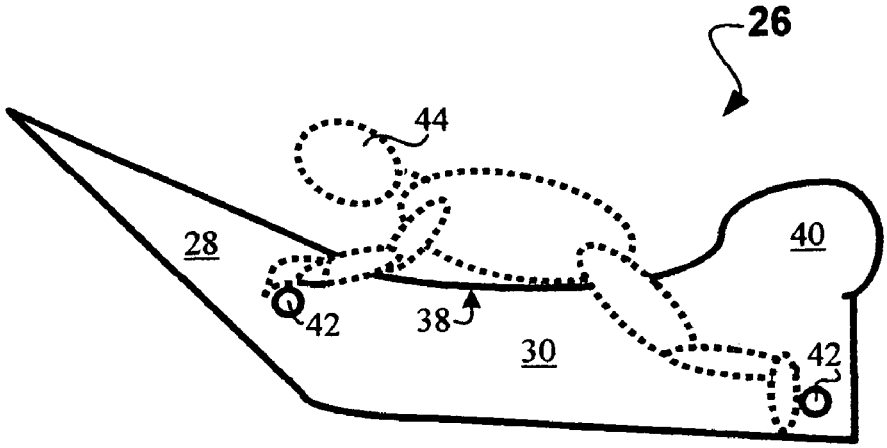
FIG. 6 is a side view of a person lying rearward on a banister for a bathing apparatus for an embodiment of the present invention.
Figure 7:
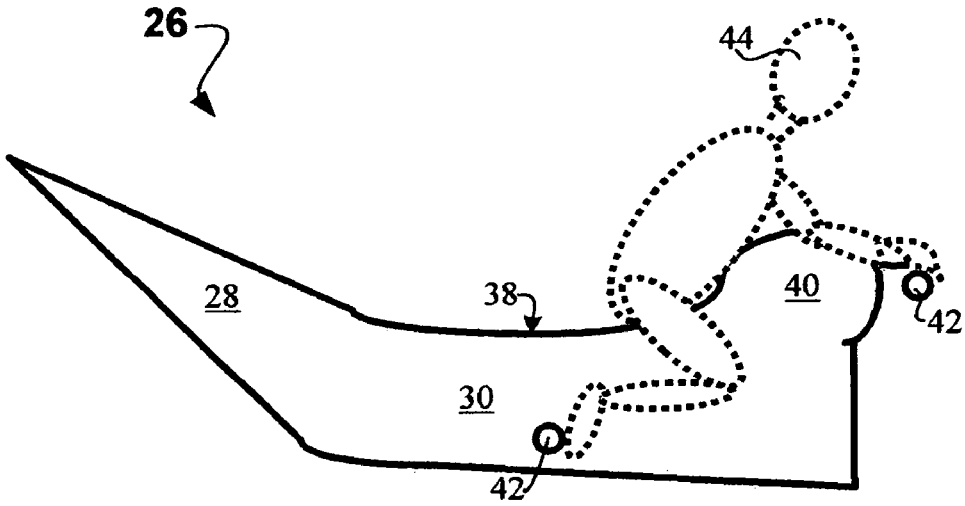
FIG. 7 is a side view of a person sitting forward on the banister of FIG. 6.
Figure 8:
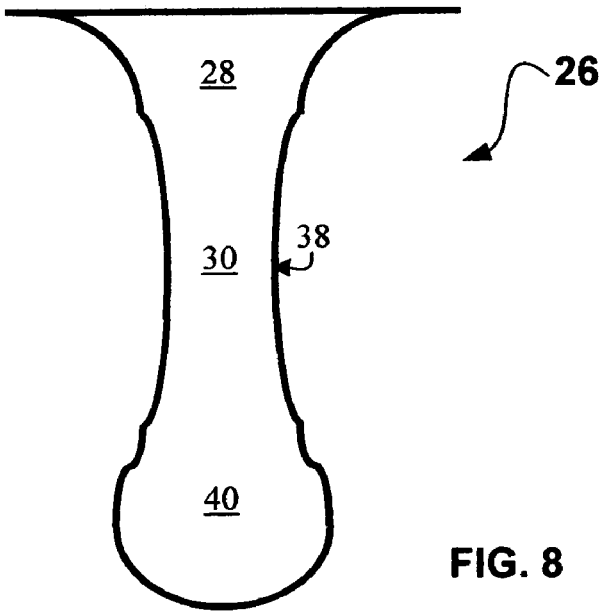
FIG. 8 is a top view of the banister of FIG. 6.

FIGS. 6–8 show a third embodiment of a banister 26. FIG. 6 shows a bather 44 lying on the belly facing rearward, with respect to the enlarged portion 40. FIG. 7 shows a bather 44 sitting forward. The bather's 44 legs straddle and are stabilized by the banister 26. Further stability is provided by the extensions 42, providing hand and foot holds, thus providing support and leverage for the arms and legs of the bather 44. In this third embodiment, the upper surface 38 of the substantially level portion 30 curves downward in the direction of the floor in a concave manner, for the purpose of providing more comfort and support to the bather. The enlarged portion 40 has a rounder, fuller shape than in the first and second embodiments of FIG. 1 and FIG. 3, providing support to the belly of the bather 44 of FIG. 7.

FIG. 8 shows a top view of this third embodiment of a banister 26. The substantially level portion 30 and its upper surface are both concave, laterally and inwardly toward the center of the level portion 38, so as to cause the level portion 30 to be fairly narrow at its center in the top view of FIG. 8. The enlarged portion 40 protrudes in a circular faction from the substantially level portion 30 and its upper surface 38. In this third embodiment, the bather 44 encounters few flat surfaces and more curved surfaces that are perhaps more comfortable and offer more support.

A bathing apparatus in accordance with the invention could serve patients who might need speedy service after vomiting or other bodily accidents. Such patients could be more effectively served by perhaps having a nearby heated reservoir of water equal to or greater than the tub capacity to speed the filling of the tub at a default temperature. The use of jets would certainly aide health workers. Moreover, the addition of a garbage disposal to the drain 16 would prevent clogging of plumbing downstream. Some consideration may also be given to recycling and sanitizing the water in a manner similar to car washes.

For tubs, Jacuzzis™, or whirlpool baths that employ earlier designs, a banister that attaches to an end of the tub, could be swiveled upward by a common rope and pulley arrangement attached to the base of the banister, and serve a similar purpose.

The present invention has been shown in the disclosed embodiments for purposes of illustration only. The present invention may be subject to many modifications and changes, that would be readily apparent to one skilled in the art, without departing from the principles and essential characteristics thereof. I claim therefore the present invention with all such changes and modifications as come within the principles and scope of the following claims.

What is claimed is:

1. A bathing apparatus to assist bathing of a disabled bather, comprising:

a bathtub having walls that define at least in part a floor and a ramp joining the floor;

the ramp defining a slope with respect to the floor;

a banister hingedly connected to and operable for rotation about a sidewall of the bathtub associated with defining the ramp, the banister when rotationally positioned for supported placement within the bathtub to extend over the ramp and over a substantial length of the floor, the banister comprising:

a descending portion having a slope to allow a bather upon entry at the sidewall to slide his seat downwardly along the descending portion; and a bench portion that transitions longitudinally from the descending portion, the bench portion defined in part by a seating surface of a substantially horizontal extent along its length and disposed at a given height above the floor of the bathtub suitable for seating a bather.

2. The bathing apparatus of claim 1, further comprising a drain; the floor gradually sloping towards the drain.

3. The bathing apparatus of claim 1, wherein the banister further comprises an enlarged portion extending outwardly from the bench portion, the enlarged portion operable to provide support and leverage for limbs of a bather.

4. The bathing apparatus of claim 3, wherein the enlarged portion is located at an end of the bench portion that is more distant from the descending portion.

5. The bathing apparatus of claim 1, wherein the upper surface of the bench portion defines a height less than that of the walls of the bathtub.

6. The bathing apparatus of claim 5, wherein the height defined by the upper surface of the bench portion gradually changes along its length.

7. The bathing apparatus of claim 1, wherein at least a portion of a surface of the banister, per a lateral cross section, curves radially toward the floor to assist straddling by a bather when seated thereon.

8. The bathing apparatus of claim 1, wherein the sidewall defining the ramp and the banister meet at an elevation operable to allow a bather substantial ease in transfer thereto from a seat of a wheel chair.

9. The bathing apparatus of claim 1 further comprising extensions that jut outwardly from the contoured surface of the bench portion operable to provide means by which to support limbs of the bather.

10. The bathing apparatus of claim 1, wherein the descending portion of the banister defines a slope more gradual than that defined by the ramp.

11. A bathing apparatus comprising:

a bathtub having walls defining an interior for receiving water and a bather for bathing;

a banister hingedly coupled to a sidewall of the walls for the bathtub; said banister comprising a descending portion; and a level portion;

the descending portion comprising a surface that defines a downward slope that extends toward the level portion;

the level portion extending longitudinally from the descending portion and over a floor of the bathtub, the level portion having an upper surface defining a substantially horizontal bench of a length and a height suitable for seating a bather.

12. The bathing apparatus of claim 11, wherein the walls of the bathtub define an outline, per an overhead view, that is substantially circular.

13. The bathing apparatus of claim 11, wherein the walls of the bathtub define an outline, per an overhead view, that is substantially pentagonal.

14. The bathing apparatus of claim 11, wherein the walls of the bathtub define an outline, per an overhead view, that is substantially rectangular.

15. The bathing apparatus of claim 11, further comprising a drain, the floor sloping towards the drain.

16. The bathing apparatus of claim 11, wherein the banister further comprises an enlarged portion at an end of the level portion that defines a curved surface at the end of the banister of a width and height greater than that for the level portion.

17. The bathing apparatus of claim 11, wherein the substantially horizontal bench is defined by the upper surface of the level portion for height less than the height of the walls of the bathtub.

18. The bathing apparatus of claim 11, wherein the upper surface of the level portion defines a height over the floor that varies along its length.

19. The bathing apparatus of claim 11, wherein the level portion, per a lateral cross section defines a surface that curves concavely along a direction toward the floor.

20. The bathing apparatus of claim 11, wherein the descending portion of the banister pivotally connects to the sidewall at a height operable to assist transfer of a disabled bather thereto from a seat of a wheel chair.

21. The bathing apparatus of claim 11, further comprising extensions that jut outwardly from a surface of the level portion, the extensions operable to support limbs of a bather.

22. The bathing apparatus of claim 11, wherein the downward slope defined by the descending portion of the banister descends less quickly than a ramp defined by the sidewall to which the banister is pivotally connected.

23. A bathing apparatus to assist bathing of a disabled bather, comprising:

walls and a floor joined to the base of the walls for defining a reservoir to receive water for bathing;

a rear wall of the walls defining in part a ramp that slopes downwardly toward the floor;

a banister pivotally coupled to the rear wall and, when positioned for supported placement on the floor, the banister comprising:

a descending portion that transitions to a level portion for extending longitudinally between sidewalls of the walls toward a front wall thereof opposite the rear wall;

the descending portion comprising a surface that extends from about an upper rim of the rear wall to the level portion of the banister and defines a slope of magnitude less than that defined by the ramp of the rear wall, the surface of the descending portion operable to allow a bather, upon entry at the rear wall, to slide seated thereon toward the level portion; and the level portion comprising a surface defining a substantially horizontal extent disposed longitudinally over the floor between the sidewalls and operable to allow a bather to straddle or sit thereon with feet extended toward or resting on the floor.

24. An apparatus to assist bathing a patient, comprising:

a surface contoured to define at least in part sidewalls and a floor to a primary reservoir operable to receive water for bathing a patient;

a banister disposed between the sidewalls and over the floor of the primary reservoir;

the banister extending from a rear sidewall of the sidewalls and into the primary reservoir toward a front sidewall of the sidewalls, and standing between left and right sidewalls of the sidewalls to divide the primary reservoir into left and right sub-reservoir regions;

the banister, per a profile view, comprising:

a sloped portion that extends from the rear sidewall with a downward slope, a platform portion that extends further inwardly from the sloped portion, the platform adapted to seat a patient within and above the floor of the primary reservoir, and a forward end portion to terminate the longitudinal length of the banister at an end thereof distal the rear sidewall, the forward end portion comprising, per a top view, a width greater than a width of the sloped portion and greater than a width of the platform portion near the sloped portion.

25. The apparatus of claim 24, in which the forward end portion of the banister comprises a transition region that meets the platform region and transitions a slope of the banister upward.

26. The apparatus of claim 25, in which an upper surface of the platform region defines a profile that is substantially horizontal.

27. The apparatus of claim 25, in which the forward end portion defines part of a rounded termination for the banister.

28. The apparatus of claim 24, in which the banister further comprises means to support the slope portion and the platform portion relative to the floor of the primary reservoir.

29. The apparatus of claim 28, in which the floor comprises:

a portion that defines an opening to a drain disposed near the front sidewall; and a descending surface that defines a ramp that extends from a base of the rear sidewall, per a cross-sectional view, toward the drain.

30. The apparatus of claim 29, in which the left and right sub-reservoir regions are in communication with each other around the banister over the drain.

31. The apparatus of claim 30, the left and right sub-reservoir regions in further communication with each other via apertures through the support means.

32. The apparatus of claim 30, the banister contiguous with the sidewalls and the floor associated with the contoured surface that defines the primary reservoir.

33. The apparatus of claim 30, the banister removably attached to the contoured surface that defines the primary reservoir.

34. The apparatus of claim 24, in which the rear sidewall comprises:

a base region that meets the floor for the primary reservoir, and an upper region at an elevation related to a depth for the primary reservoir; and the sloped portion of the banister meets the upper region of the rear sidewall.

35. The apparatus of claim 34, in which the sloped portion of the banister meets the upper region of the rear sidewall at an elevation above ground level.

36. The apparatus of claim 35, in which the elevation where the sloped portion meets the upper region of the rear sidewall is operable to ease transfer of a patient thereto from a seat of a wheel chair.

* * * * *